US008403594B2

(12) United States Patent
Neumann

(10) Patent No.: US 8,403,594 B2
(45) Date of Patent: Mar. 26, 2013

(54) AGGREGATE-SPREADING DEVICE

(76) Inventor: Duane A. Neumann, Jefferson, WI (US)

( * ) Notice: Subject to any disclaimer, the term of this patent is extended or adjusted under 35 U.S.C. 154(b) by 0 days.

(21) Appl. No.: 13/597,933

(22) Filed: Aug. 29, 2012

(65) Prior Publication Data

US 2013/0017017 A1 Jan. 17, 2013

Related U.S. Application Data

(62) Division of application No. 12/813,770, filed on Jun. 11, 2010.

(51) Int. Cl.
*E01C 19/00* (2006.01)

(52) U.S. Cl. ..... 404/110; 404/101; 404/104

(58) Field of Classification Search ..... 404/101, 404/104, 105, 107, 108, 110, 118
See application file for complete search history.

(56) References Cited

U.S. PATENT DOCUMENTS

| | | | | | |
|---|---|---|---|---|---|
| 2,953,977 | A * | 9/1960 | Warren | 404/110 |
| 3,108,517 | A * | 10/1963 | Fingland | 404/110 |
| 3,213,769 | A * | 10/1965 | Smith | 404/110 |
| 3,482,494 | A * | 12/1969 | Jennings, Jr. | 404/110 |
| 3,526,173 | A * | 9/1970 | Brandstetter et al. | 404/108 |
| 4,102,590 | A * | 7/1978 | Zanzie | 404/110 |
| 4,789,980 | A * | 12/1988 | Darcie et al. | 370/430 |
| 4,892,155 | A | 1/1990 | Wanamaker | |
| 4,936,392 | A | 6/1990 | Kitchin | |
| 5,098,252 | A | 3/1992 | Sheesley et al. | |
| 5,599,135 | A | 2/1997 | Delaurenti | |
| 5,701,693 | A | 12/1997 | Brocious et al. | |
| 5,895,173 | A | 4/1999 | O'Brien et al. | |
| 6,050,744 | A * | 4/2000 | Binning | 404/108 |
| 6,089,785 | A * | 7/2000 | Bergman | 404/101 |
| 6,203,244 | B1 * | 3/2001 | Van Ornum | 404/110 |
| 6,322,287 | B1 * | 11/2001 | Yelton | 404/118 |
| 6,345,931 | B1 * | 2/2002 | Capece | 404/101 |
| 6,386,822 | B1 | 5/2002 | Burr | |
| 6,560,904 | B2 | 5/2003 | Guggino | |
| 6,619,882 | B2 | 9/2003 | Harvey | |
| 6,702,208 | B1 | 3/2004 | Hadley et al. | |
| 7,108,450 | B2 * | 9/2006 | Grubba | 404/84.5 |
| 7,273,111 | B2 | 9/2007 | Johnson | |
| 7,540,687 | B2 | 6/2009 | Neumann | |
| 2009/0194959 | A1 | 8/2009 | Mintie et al. | |
| 2010/0209190 | A1 | 8/2010 | Munz et al. | |
| 2011/0305551 | A1 | 12/2011 | Neumann | |

OTHER PUBLICATIONS http://www.lbperformancepaving.com/Home/Products/RoadWideners.aspx (as page appears Nov. 30, 2012).
http://www.youtube.com/watch?v=-BBTQZCBoOg&feature=player_embedded (screen shot as page appears on Nov. 30, 2012)(video uploaded Feb. 19, 2009).
http://www.youtube.com/watch?v=mPSoX508bFQ (screen shot as page appears on Nov. 30, 2012)(Video uploaded Dec. 2, 2011).

(Continued)

*Primary Examiner* — Raymond W Addie
(74) *Attorney, Agent, or Firm* — Boyle Fredrickson, S.C.

(57) ABSTRACT

An aggregate-spreading device is disclosed for widening roads, filling trenches, spreading any kind of road construction material, and creating shoulders on the side of roads at a controllable, quick, and steady pace. The aggregate-spreading device may be controlled by electronic motors and electronic actuators. The aggregate-spreading device is equipped with a skeletal frame, either a first and a second adjustable spreader assembly attached on opposing ends of the skeletal frame, or a single spreader assembly for allowing an operator precise control over placement of an aggregate. The aggregate may be supplied to the first or second adjustable spreader assemblies by adjusting the rotation of a reversible conveyor system. The skeletal frame simplifies manufacturing of the aggregate-spreading device and allows for easy repairs and maintenance. The electronic motors and electronic actuators eliminate the need for hydraulics, allowing an operator to control the device from a remote location with a controller.

20 Claims, 16 Drawing Sheets

OTHER PUBLICATIONS http://www.midlandmachinery.com/ (as page appears Nov. 30, 2012).

http://www.weilerproducts.com/products/road-wideners (as page appears Nov. 30, 2012).

* cited by examiner

AGGREGATE-SPREADING DEVICE

CROSS-REFERENCE TO RELATED APPLICATIONS

This application is a divisional application of and claims a benefit of priority under 35 USC §119, based on U.S. patent application Ser. No. 12/813,770, filed Jun. 11, 2010 now published as U.S. Publication No. 2011/0305551, the entire contents of which are hereby expressly incorporated by reference into the present application.

BACKGROUND OF THE INVENTION

Devices for road widening and creating shoulders are known in the road construction industry. Many of the devices are designed for use only on either the right side of the road or the left side of a road. Oftentimes different machines must be kept on the construction site for road construction on the left and right sides of the road or the machine must be driven in a different direction. This not only increases construction costs by necessitating multiple machines, but also increases construction time as well.

U.S. Pat. No. 7,540,687, the entire contents of which are expressly incorporated for reference, discloses the use of hydraulics for movement of aggregate-spreading systems. The hoses in these hydraulic systems may be prone to leaks and failure over time which requires maintenance and cleaning of the machine. Additionally, hydraulics can be difficult to control when precise, fine adjustments are necessary. Hydraulic fluid, hoses, and pistons also add considerable weight to the existing devices.

Another feature of known devices is that they are self-propelled. Many of the devices include large engines with transmissions for moving the device. This adds considerable costs as well as weight to the device.

What is therefore needed in the road construction industry is a low-cost device that may be either pushed by another vehicle such as a skid steer or attached to a rear end of an aggregate storage vehicle such as a dump truck, thus eliminating the need for an engine and drivetrain. Also needed is a device that eliminates hydraulics and utilizes electronic actuators and electronic motors for operation of the device. Another feature needed is a device that is constructed in a lightweight design, allowing for easier mobility, repairs, and maintenance.

SUMMARY AND OBJECTS OF THE INVENTION

One object of the invention is to provide an aggregate-spreading device that may be attached either to a vehicle such as a skid steer and pushed behind a dump truck or suspended directly to the rear of a vehicle such as a dump truck, allowing the aggregate-spreading device to receive aggregate from the dump truck.

In accordance with one object of the invention, a spreader assembly may be attached on either both sides of the device or on a single side. The spreader assemblies are configured to extend and retract to and from the device and also may pivot allowing an angular adjustment. This movement may be accomplished with the use of electronic actuators, allowing an operator to have precise control over the width and depth of the aggregate that is spread.

In accordance with another aspect of the invention, a conveyor may be controlled with the controller to rotate in one direction for supplying aggregate to a spreader assembly on one side of the device, and controlled to reverse the rotation so as to supply aggregate to a spreader assembly on the opposite side of the device. This allows for the same device to be used when spreading aggregate on either side of the road while operating the machine in any desired direction.

In accordance with yet another aspect of the invention, the device is constructed on a skeletal frame with various components attaching to the frame including a height adjustable hopper. This allows for a modular construction and assists maintenance and repair work as various components may be removed or replaced with ease. Manufacturing costs are also lowered as is the overall weight of the device.

Another object of the invention is to provide an apparatus that has one or more of the characteristics discussed above in various combinations, thus, allowing for a reduced labor time and labor effort when spreading aggregate on a job site. These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
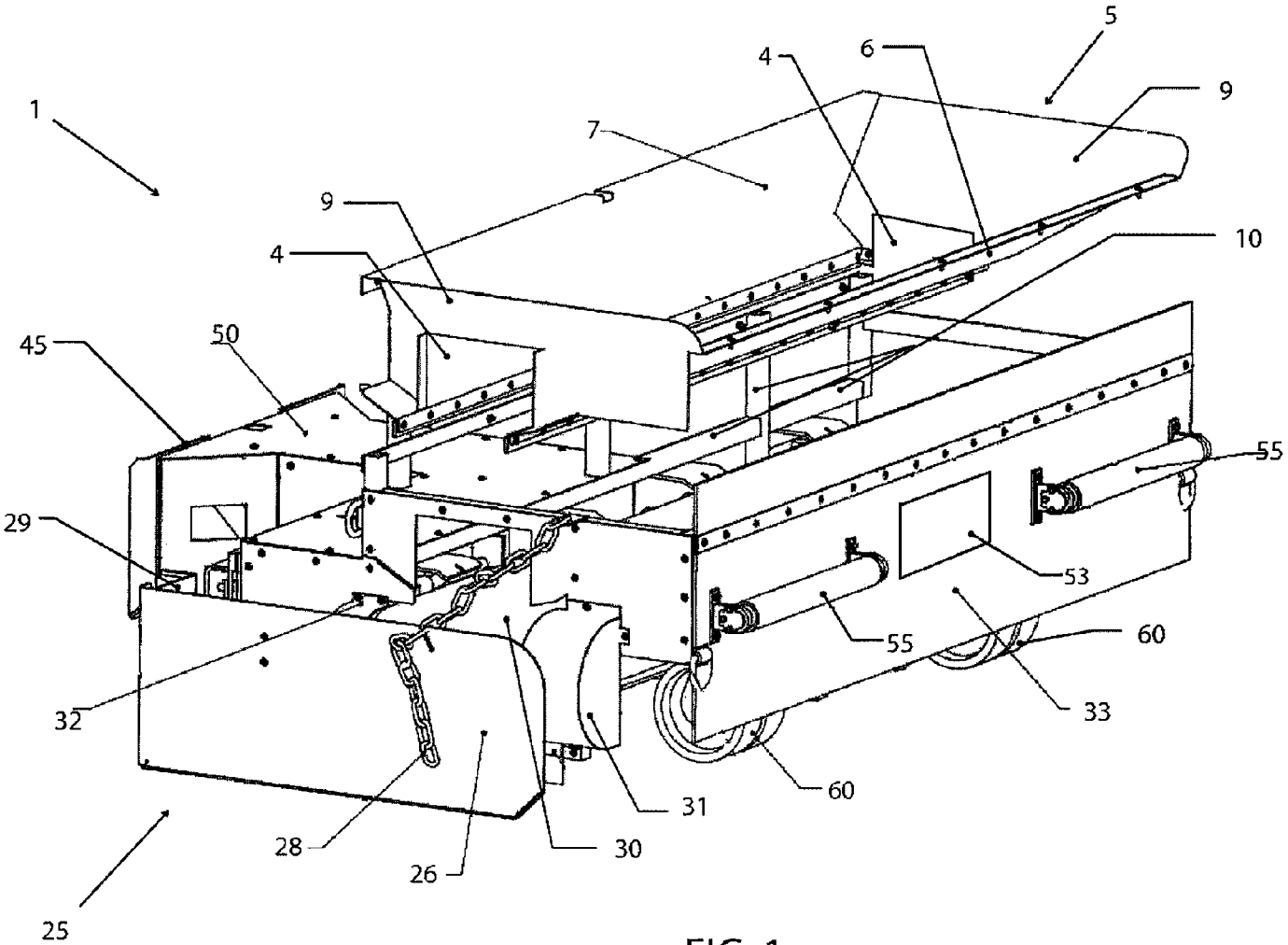
FIG. 1 illustrates an orthogonal view of the inventive aggregate-spreading device with a dual spreader assembly.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DESCRIPTION OF EMBODIMENTS

1. Overview

The present invention is directed to a device for spreading aggregate such as gravel on the side of the road. An effect of the present invention is to allow a road construction crew to widen or create a shoulder or road while minimizing the amount of time and labor required. One aspect of the invention is to provide an apparatus that is constructed on a skeletal frame and incorporates electronic motors and electronic actuators. Such an apparatus has the ability to spread aggregate all while being controlled with a manual controller that may be located remotely. The manual controller controls the electronics including electronic actuators and electronic motors to vary a conveyor speed, vary the conveyor's rotation direction, and control movement of the spreader assemblies.

An aggregate-spreading device is disclosed with a first and a second spreader assembly. The aggregate-spreading device is built on a skeletal frame. A hopper, for receiving an aggregate from a vehicle such as a dump truck is attached to the skeletal frame by a single hopper support bar for receiving the aggregate. Aggregate is understood to include a multitude of construction materials including, but not limited to, gravel, sand, soil, stone, hot asphalt, crushed cement, wet cement, and any other material used to construct roads. A tailgate stop extends from the support bar for limiting the dump truck's tailgate from over-extending and spilling aggregate onto undesired locations. A tailgate stop prevents the tailgate of the dump truck from opening beyond a desired amount and assures that aggregate is only supplied into the hopper. The hopper is constructed of a front wall, a back wall, and a cutout wall on each side of the hopper. The cutout walls include a cutout. A conveyor drive unit assembly is attached to the skeletal frame at either end of the conveyor, or may be attached at both ends of the conveyor, by threaded rods that attach to insertion points. This allows the conveyor drive unit assembly to be positionable, varying the tension of the conveyor. The conveyor drive unit assembly drives the conveyor in a rotating motion. The conveyor rotates by wrapping around conveyor drive which is made up of a plurality of T-shaped extensions that converge on a single roller that is supported by a bearing on each end of the single roller. The conveyor drive is rotated by a conveyor motor. The conveyor motor may transfer rotating motion directly to the single roller with a chain that attaches to the single roller in between a first bearing plate and a second bearing plate. The conveyor rotates surrounding a path that includes a plurality of rollers that are supported on the skeletal frame by roller mounts. The conveyor motor may also be a reversible motor that rotates the conveyor, plurality of rollers, and conveyor drive in a first direction and may reverse rotation to rotate the conveyor in a second direction. This allows aggregate to be delivered to either side of the aggregate-spreading device. A conveyor shield protects the edges of the conveyor. A chain shield protects the chain from any foreign objects. A first spreader assembly attached to a first end of the skeletal frame may be extended to and from the skeletal frame for controlling how wide aggregate will be spread from the skeletal frame. A second spreader assembly attaches to a second end of the skeletal frame opposite the first end and also includes a variable extension distance from the skeletal frame.

The aggregate-spreading device may be controlled by any electronic device, preferably a controller in communication with the conveyor motor, the first spreader assembly, and the second spreader assembly. The aggregate-spreading device may also be equipped with either hydraulics, electronic actuators, or a combination thereof for controlling the movement of the spreader assemblies. The controller may operate in a wireless fashion and be located inside a dump truck that supplies aggregate to the aggregate-spreading device, inside a vehicle such as a skid steer that pushes the aggregate-spreading device, or anywhere an operator may wish to be while controlling the device. The controller is preferably operated by a user with manual inputs and may be mounted inside the skid steer or dump truck or simply handheld. The controller may be operated to control the rotation of the conveyor to supply aggregate to the first spreader assembly when rotating in one direction and supply aggregate to the second spreader assembly when rotating in the opposite direction, control the conveyor rotation speed, and also control movement of the spreader assemblies. The controller controls the aggregate-spreading assemblies by communicating with a plurality of electronic actuators. The electronic actuators provide power to pistons that extend the aggregate-spreading assemblies to and from the skeletal frame and also provide an angular adjustment.

The pistons are controlled in order to determine the width and depth of the distributed aggregate. The controller and electronic actuators control the spreader assemblies so that they may be moved in multiple directions. For example, each spreader assembly is equipped with a piston, chain, and angular adjustment guide. The first spreader assembly includes a first spreader plate, a first spreader extension connected to the first spreader plate at approximately a right angle, a first chain attaching an end of the spreader plate to the skeletal frame, a first piston, and an angular adjustment guide. Also included in the second spreader assembly is a second spreader plate, a second piston, a second chain, an angular adjust guide, and a second spreader extension.

As aggregate is delivered into the hopper, it falls onto the conveyor which delivers the aggregate to either the first spreader assembly or the second spreader assembly depending on the inputs provided to the controller by an operator. As the aggregate is supplied to either one of the spreader assemblies, the spreader assemblies may be moved in a manner placing the first or second spreader plate closer or further away from the skeletal frame by extending or retracting the piston with input to the controller, and the spreader assemblies may be adjusted with an angular adjustment. This angular adjustment allows the spreader assemblies to tilt in the vertical direction so that the first spreader plate or the second spreader plate is closer or further away from the ground. The angular adjustment guides provide a maximum and a minimum adjustment distance as well. The first and second chains are attached to the skeletal frame and may be attached to the first or second spreader plates to provide additional support under the weight of supplied aggregate and the weight of the extended spreader assemblies themselves.

As discussed above, the aggregate-spreading device may be fastened to the front of a vehicle such as a skid steer but may optionally be fastened to any vehicle and pushed behind a dump truck. Contact rollers attached to the skeletal frame on the front side of the aggregate-spreading device are designed to allow contact with the rear wheels of the dump truck and rotate when in contact. Alternatively, the aggregate-spreading device may also be attached directly to the rear end of a dump truck by attaching the auxiliary mounting plate to any attachment point on the rear end of the dump truck, such as a trailer hitch. The aggregate-spreading device also has a set of wheels allowing it to roll on the road as it is suspended behind the dump truck or pushed by a skid steer. Attaching the aggregate-spreading device directly to the rear of a dump truck eliminates the need for an additional vehicle and also lowers the labor force required to widen roads and spread aggregate.

The skeletal frame of the aggregate-spreading device is strengthened by attachment of a plurality of plates to form an exterior skin on the skeletal frame. The plates include, for example, a front plate and extension; however, any number of plates may be attached to the skeletal frame. The plurality of plates provide structural support to the skeletal frame, and because they may be removed and re-attached, they allow for simplified repairs, simplified assembly operations, and simplified maintenance operations as compared to other construction machines that do not include a skeletal frame and plate construction.

A similar aggregate-spreading device is also disclosed, however, it is equipped with a single spreader assembly on a single end of the device. The device with a single spreader assembly functions identically to the device discussed above, but simply has a single spreader assembly. As there is only one spreader assembly, the conveyor only delivers aggregate to that side of the device. The hopper also includes one cutout wall with the cutout on the side of the device with the spreader assembly. The spreader assembly is similarly equipped with a spreader plate, spreader extension, piston, and chain, and operates identically to the spreader assemblies discussed above.

2. Detailed Description

The present invention and the various features and advantageous details thereof are explained more fully with reference to the non-limiting embodiments described in detail in the following description.

Figure 2:
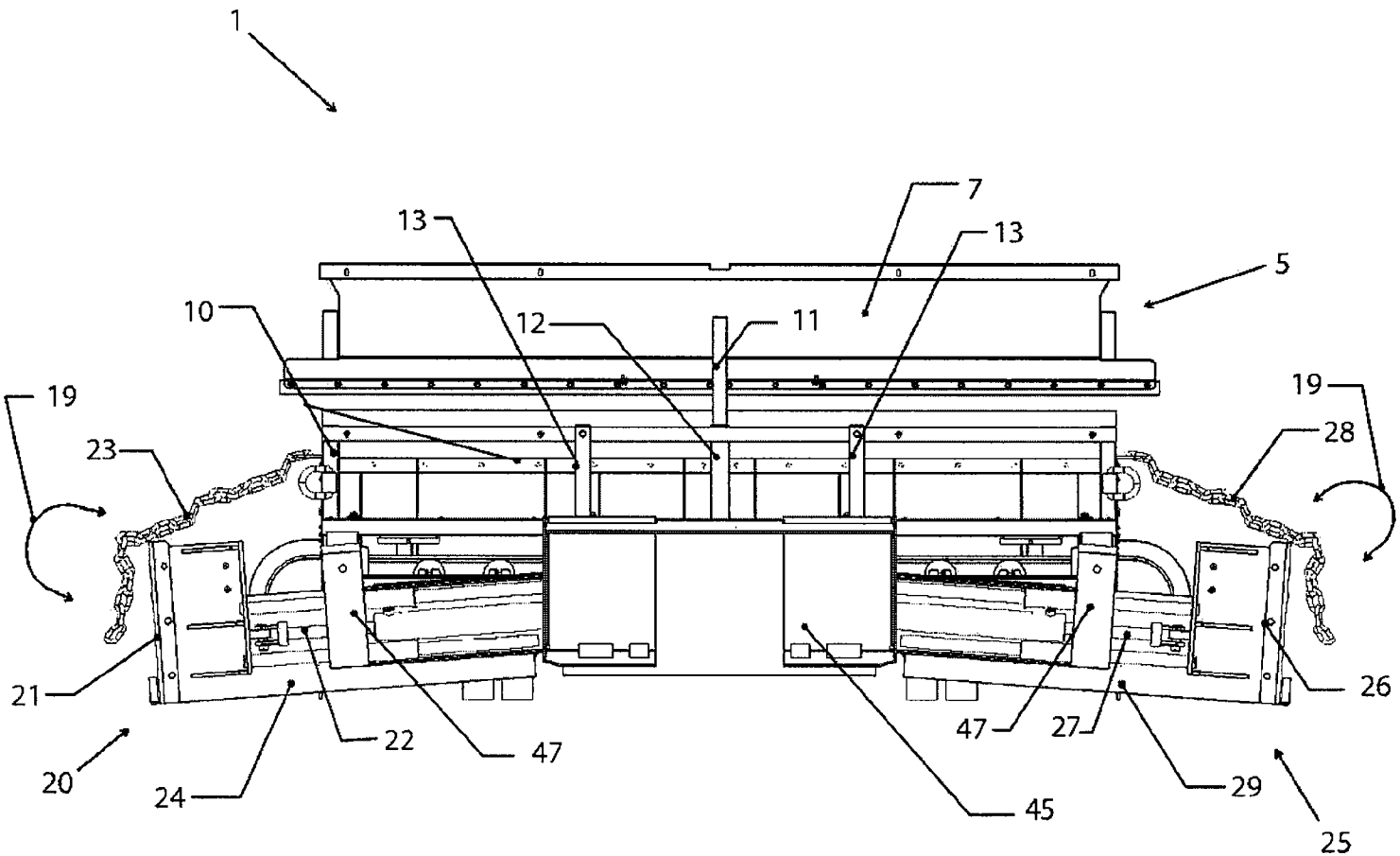
FIG. 2 illustrates a back view of the aggregate-spreading device of FIG. 1.
Figure 15:
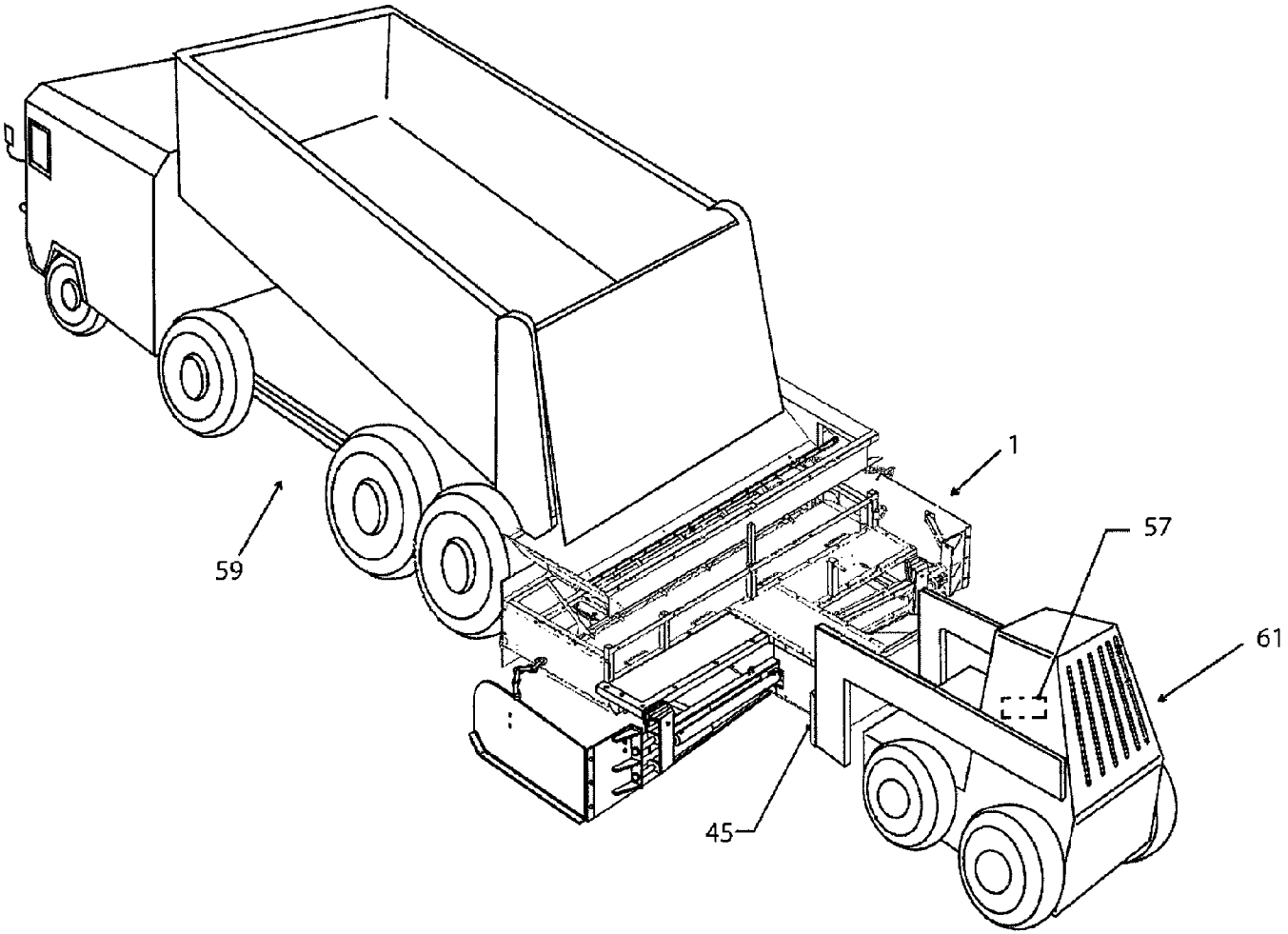
FIG. 15 illustrates an orthogonal view of the aggregate-spreading device of FIG. 1 in operation while attached to a skid steer.
Figure 16:
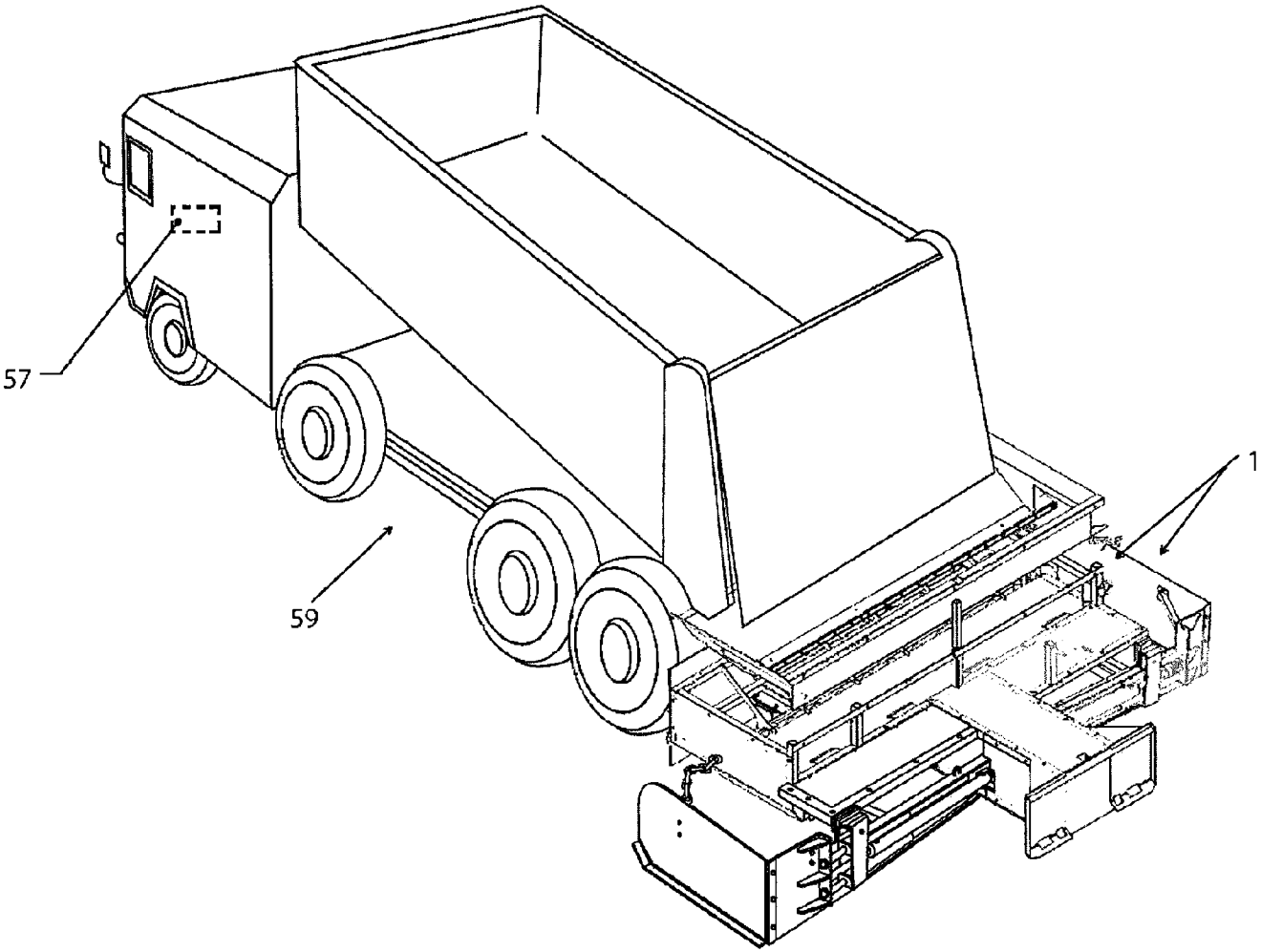
FIG. 16 illustrates an orthogonal view of the aggregate-spreading device of FIG. 1 in operation while attached to a rear end of a dump truck.

Beginning with FIG. 1, an aggregate-spreading device 1 is disclosed. The aggregate-spreading device 1 is constructed on a skeletal frame 10 with a plurality of plates attached to the exterior of the skeletal frame 10, including a front plate 33 and an extension 50, however, any number of additional plates may also be attached to the skeletal frame for increased rigidity and protection from damage. Also attached to the skeletal frame 10 by a hopper support bar 12, better seen in FIG. 2, is a hopper 5. The hopper 5 is constructed out of a back wall 7, a front wall 6, and cutout walls 9. The cut out walls 9 each includes a cutout 4. The hopper 5 is configured for receiving aggregate and delivering it to a conveyor 30 below. Aggregate is understood to include a multitude of construction materials including, but not limited to, top soil, wet concrete, hot asphalt, sand, gravel, crushed concrete, recycled materials, stone, and any other material used in road construction. A conveyor shield 32 guards the edge of the conveyor 30 and a chain shield 31 protects the conveyor's drive chain. The aggregate-spreading device 1 may be attached to the front of the vehicle, for example a skid steer 61, and pushed from behind with the use of a universal mount 45 as shown in FIG. 15. In this configuration, the skid steer pushes the aggregate-spreading device 1 behind the dump truck 59 that supplies aggregate to the hopper 5. A pair of contact rollers 55 is designed to contact the rear wheels of the aggregate-supplying vehicle and to rotate along with the rear wheels of the vehicle. Alternatively, the auxiliary mounting plate 53 attached to the front of the aggregate-spreading device 1 may engage with the rear of the aggregate-supplying vehicle, for example a dump truck 59, suspending the aggregate-spreading device 1 aggregate-supplying vehicle, as shown in FIG. 16. This alternative configuration eliminates the need for an additional vehicle to push the aggregate-spreading device 1. A pair of wheels 60 allows the aggregate-spreading device to roll along the ground as it moves; however, any number of wheels may be attached to the device for added support. The second spreader assembly 25 is also visible and is configured to spread aggregate that is supplied from the conveyor 30. The second spreader assembly 25 includes a second spreader plate 26, a second spreader extension 29 that is attached to the second spreader plate 26 at a right angle, and a second chain 28. The second chain 28 is attached to the skeletal frame 10 on one end and the may be attached to the second spreader plate 26 at any other in order to provide additional support to the second spreader plate 26 under the load of aggregate.

Looking now at FIG. 2, the aggregate-spreading device 1 is shown from the rear. The hopper 5 is attached to sleeve hopper support bar 12 on the skeletal frame 10. Proximate to the hopper support bar 12 is a tailgate stop 11 which prevents a dump truck's tailgate from opening beyond a desired amount as it supplies aggregate to the hopper. This limits the aggregate to being supplied only to the hopper and not to the surrounding areas. Both spreader assemblies, first spreader assembly 20, and second spreader assembly 25, are visible. First spreader assembly 20 is identical to the second spreader assembly 25 except it is attached to the opposite side of the skeletal frame 10. The first spreader assembly also includes a first piston 22 that can extend and retract the first spreader plate 21 to and from the skeletal frame 10. A first chain 23 is attached to the skeletal frame 10 and may be attached to the first spreader 21 anywhere in between the first end and the second end for supporting the weight of the first spreader assembly when extended. Second spreader assembly 25 also includes a second piston 27 that is configured to extend and retract the second spreader plate 26 to and from the skeletal frame 10. Both spreader assemblies 20, 25 may be adjusted to include an angular adjustment 19 that pivots the spreader assemblies 20, 25 about a central axis of the aggregate-spreading device 1, allowing the first spreader plate 21 and the second spreader plate 26 to have adjustable heights from the ground. The slope attachments 13 allow attachment of a ratcheting device from the slope attachment 13 to either spreader assembly 20, 25 to reinforce the positioning of the angular adjustment 19. An angular adjustment guide 47 on both the first spreader assembly 20 and the second spreader assembly 25 controls the maximum and minimum angular adjustment. The universal mount 45 is also shown and is configured to attach to a vehicle for pushing the aggregate-spreading device 1 behind a vehicle that supplies the hopper 5 with aggregate.

Figure 3:
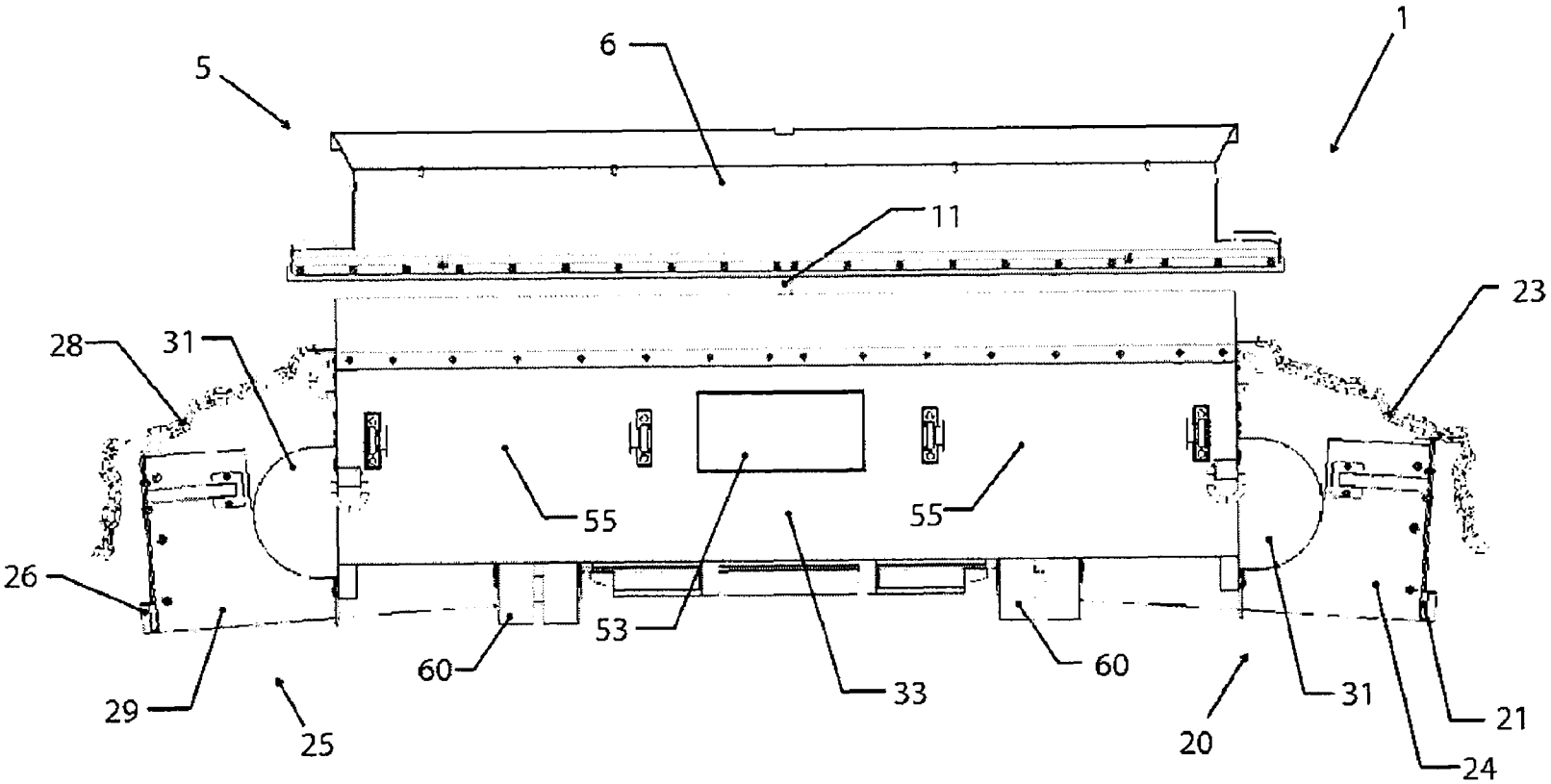
FIG. 3 illustrates a front view of the aggregate-spreading device of FIG. 1.

Referring now to FIG. 3, the front side of the aggregate-spreading device 1 may be seen. The hopper 5 is suspended above the skeletal frame 10 by the hopper support bar 12. The front plate 33 not only reinforces the skeletal frame 10 but also provides a mounting location for both contact rollers 55 and auxiliary mounting plate 53. The first spreader assembly 20 and the second spreader assembly 25 receive aggregate delivered to the aggregate-spreading device 1 and are controlled to extend, retract, and adjust in an angular direction with the use of a controller 57 seen in FIGS. 15 and 16. The controller 57 may be wired to the aggregate-spreading device 1 but is preferably a wireless controller, allowing the controller to be located in the aggregate-supplying vehicle or in the vehicle pushing the aggregate-spreading device 1.

Figure 4:
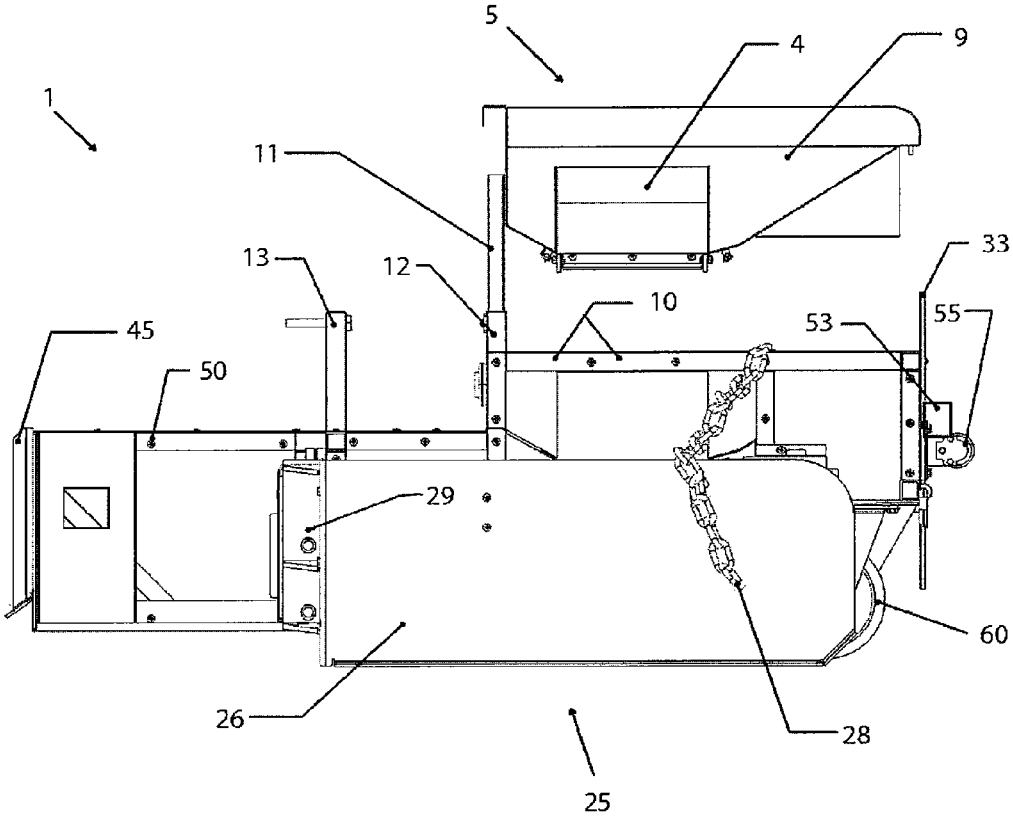
FIG. 4 illustrates a side view of the aggregate-spreading device of FIG. 1.
Figure 5:
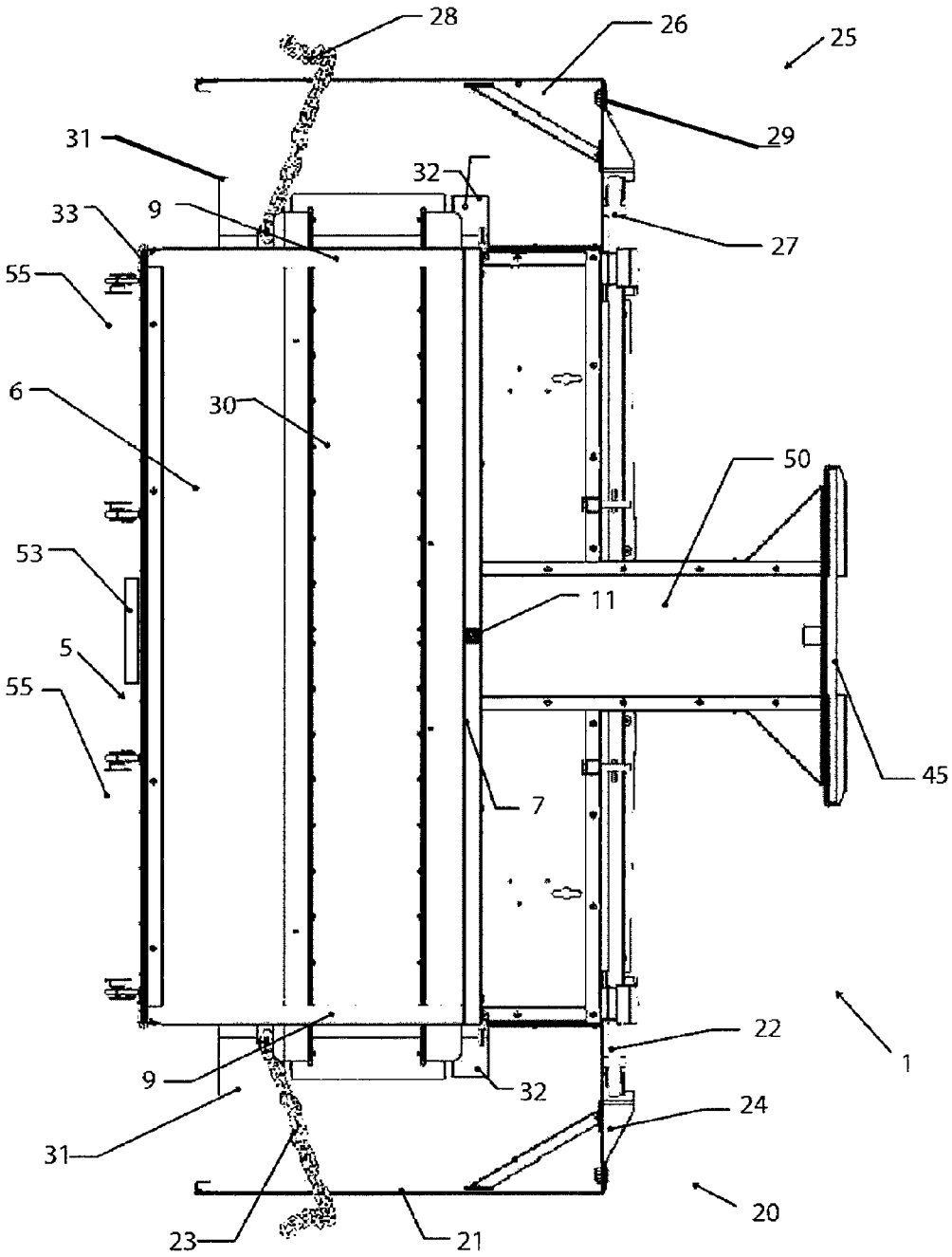
FIG. 5 illustrates a top view of the aggregate-spreading device of FIG. 1.

Turning now to FIG. 4, the aggregate-spreading device 1 is shown from the side. The hopper 5 includes a cutout 4 on the cutout wall 9. The cutout 4 may be covered or opened to assist aggregate to spill to the desired spreader assembly. A slope attachment 13 allows attachment of a ratcheting device from the slope attachment 13 to either spreader assembly for assisting in making the angular adjustment 19 discussed above. The hopper 5 is attached to the skeletal frame 10 by a single point by the hopper support bar 12. The tailgate stop 11 is extendable and limits the motion of a dump truck's tailgate. FIG. 5 shows an overhead view of the aggregate-spreading device 1. The hopper 5 is suspended directly over the conveyor 30. The conveyor 30 is chain driven to rotate in both directions. This allows the conveyor 30 to supply aggregate to the second spreader assembly 25 when rotating in one direction and to supply aggregate to the first spreader assembly 20 when rotating in the opposite direction. The rotational direction of the conveyor 30 is controlled by the controller 57. Chain shields 31 and conveyor shields 32 protect the edges of the conveyor 30 and of the chain, which is not pictured.

Figure 6:
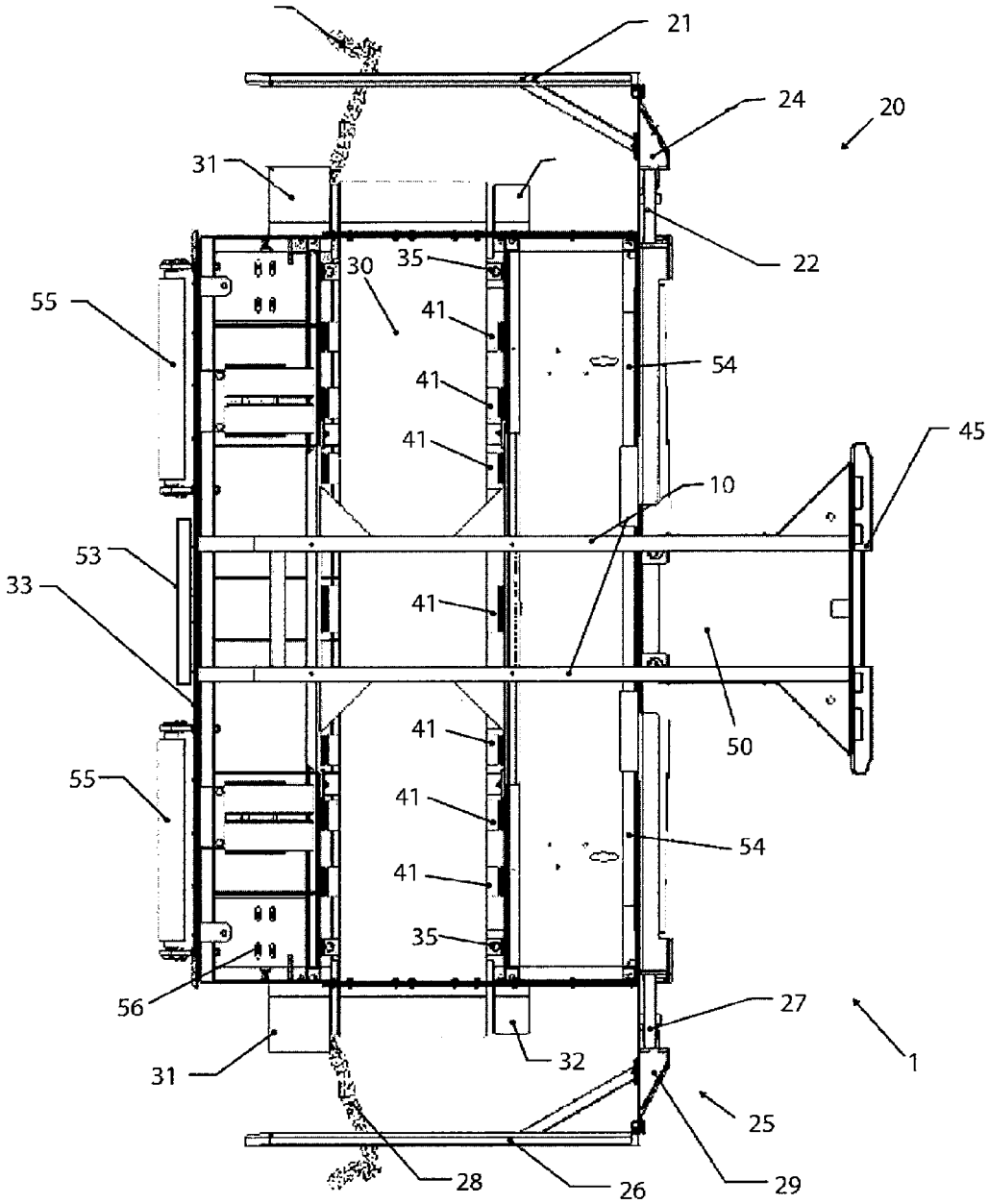
FIG. 6 illustrates a bottom view of the aggregate-spreading device of FIG. 1.

FIG. 6 shows a bottom view of the aggregate-spreading device 1. The rotation of the conveyor 30 is powered by a conveyor motor 56. The conveyor motor 56 is directly controlled by the controller 57. This allows the operator to control the rotational direction of the conveyor 30 from any location. The conveyor 30 is supported by and assisted in rotating with the help of a plurality of rollers 41 that are attached to the skeletal frame 10 on each end. The rollers 41 are preferably ball bearing rollers to minimize friction and assist the conveyor 30 in rotating. The rotation of the conveyor 30 is powered and made possible by a conveyor drive unit assembly 35, shown in detail in FIG. 8, located at each end of the conveyor 30. The rollers 41 and conveyor motor 56 attach to the skeletal frame by interlocking with a plurality of roller mounts 43, seen in FIG. 9, that are located on the skeletal frame 10 at each end of the rollers 41 and conveyor motor 46. The aggregate-spreading device 1 is equipped with a plurality of electronic actuators 54 for moving the first spreader assembly 20 and the second spreader assembly 25. Electronic actuators 54 control the first piston 22 and the second piston 27 along with the angular adjustment 19 to allow an operator precise control over any movement of the spreader assemblies 20, 25 with the use of the controller 57.

Figure 7:
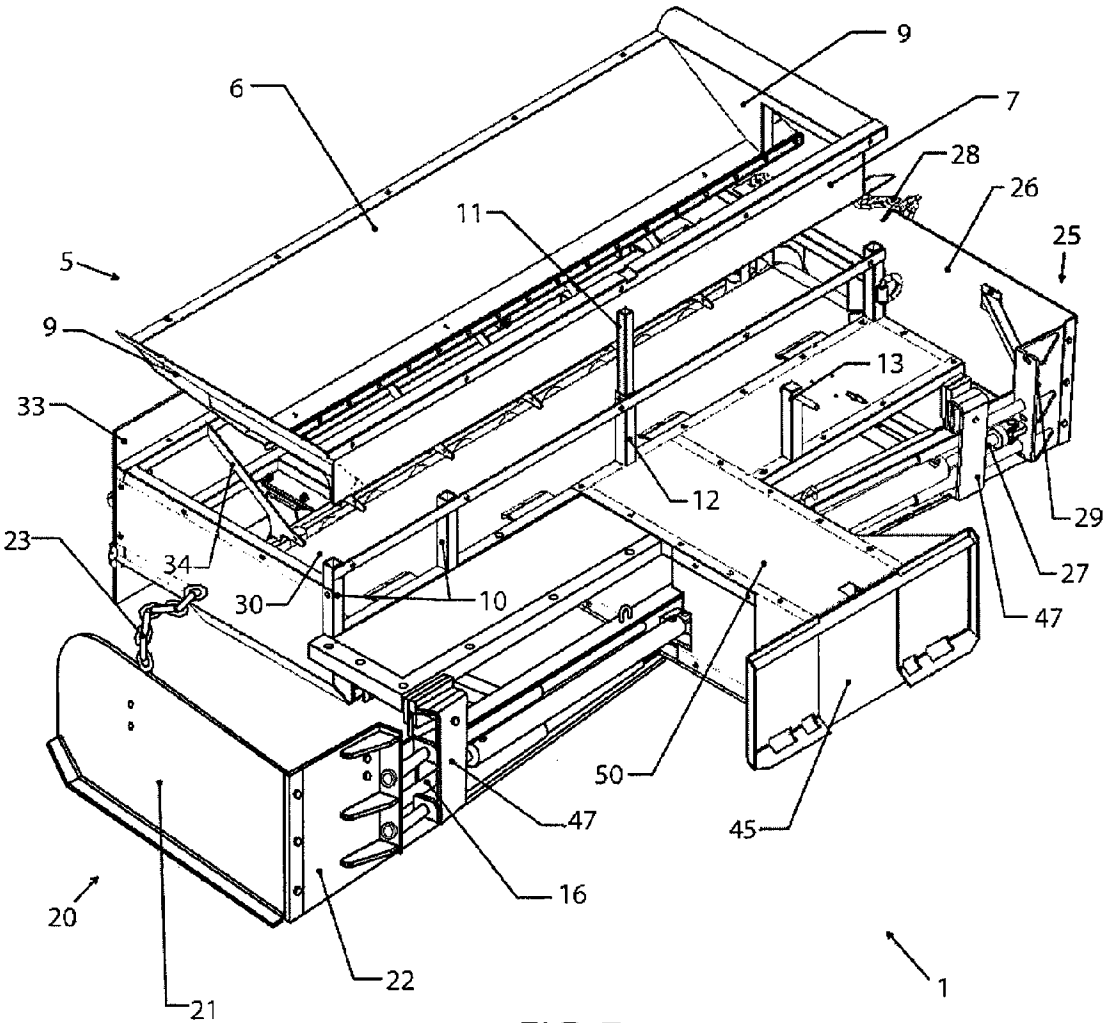
FIG. 7 illustrates another orthogonal view of the aggregate-spreading device of FIG. 1.

FIG. 7 shows an orthographic view of the aggregate-spreading device 1. Both of the first spreader assembly 20 and the second spreader assembly 25 can be seen. Angular adjustment guides 47 prevent over adjustment in the angular direction of the first and second spreader assemblies 20, 25. A front plate support 34 acts as a truss and supports the skeletal frame 10 under the load of aggregate or when being pushed from behind or suspended from an aggregate spending vehicle. While only a single front plate support 34 is seen, there are many more front plate supports, as seen in FIG. 9.

Figure 8:
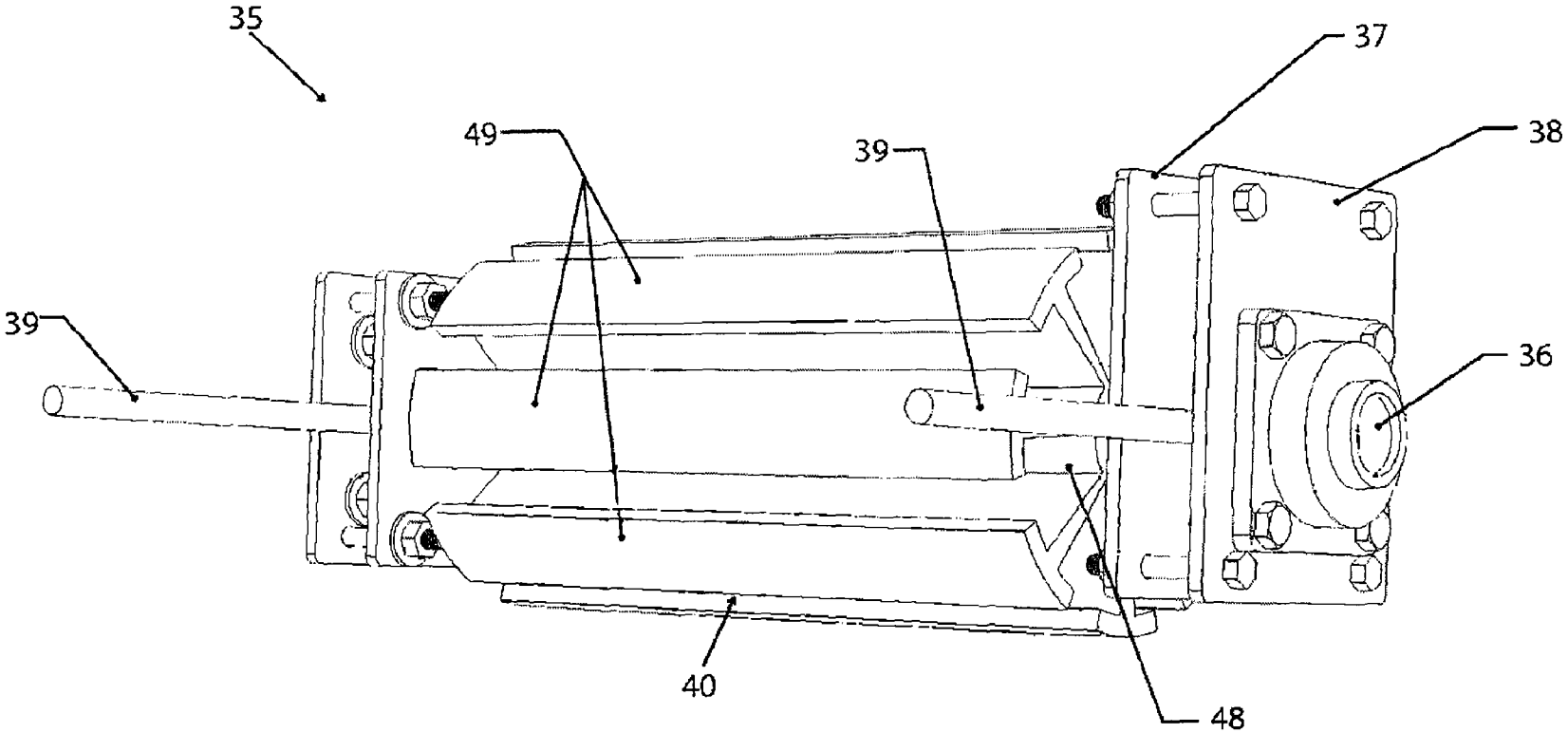
FIG. 8 illustrates an orthogonal view of a conveyor drive unit assembly of the invention.

Moving on to FIG. 8, the conveyor drive unit assembly 35 is shown. The conveyor drive unit assembly 35 is attached to the skeletal frame 10 with a pair of threaded rods 39 for securing the drive unit assembly to the skeletal frame 10. The conveyor drive unit assembly 35 is attached to skeletal frame 10 on any side proximate to a spreader assembly. The conveyor drive unit assembly 35 includes a conveyor drive 40 that is made up of a plurality of T-shaped extensions that extend from a central axis of the conveyor drive 40 and converge on a single roller 48 to form a rotating drum. The single roller 48 has a bearing 36 on each end to assist in rotation. A first bearing plate 37 and a second bearing plate 38 on the ends of the single roller 48 assist in supporting the load of the conveyor drive 40. A chain may be used to rotate the conveyor drive 40. The chain interacts with a gear in between the first bearing plate 37 and the second bearing plate 38 that is attached to the single roller 48.

Figure 9:
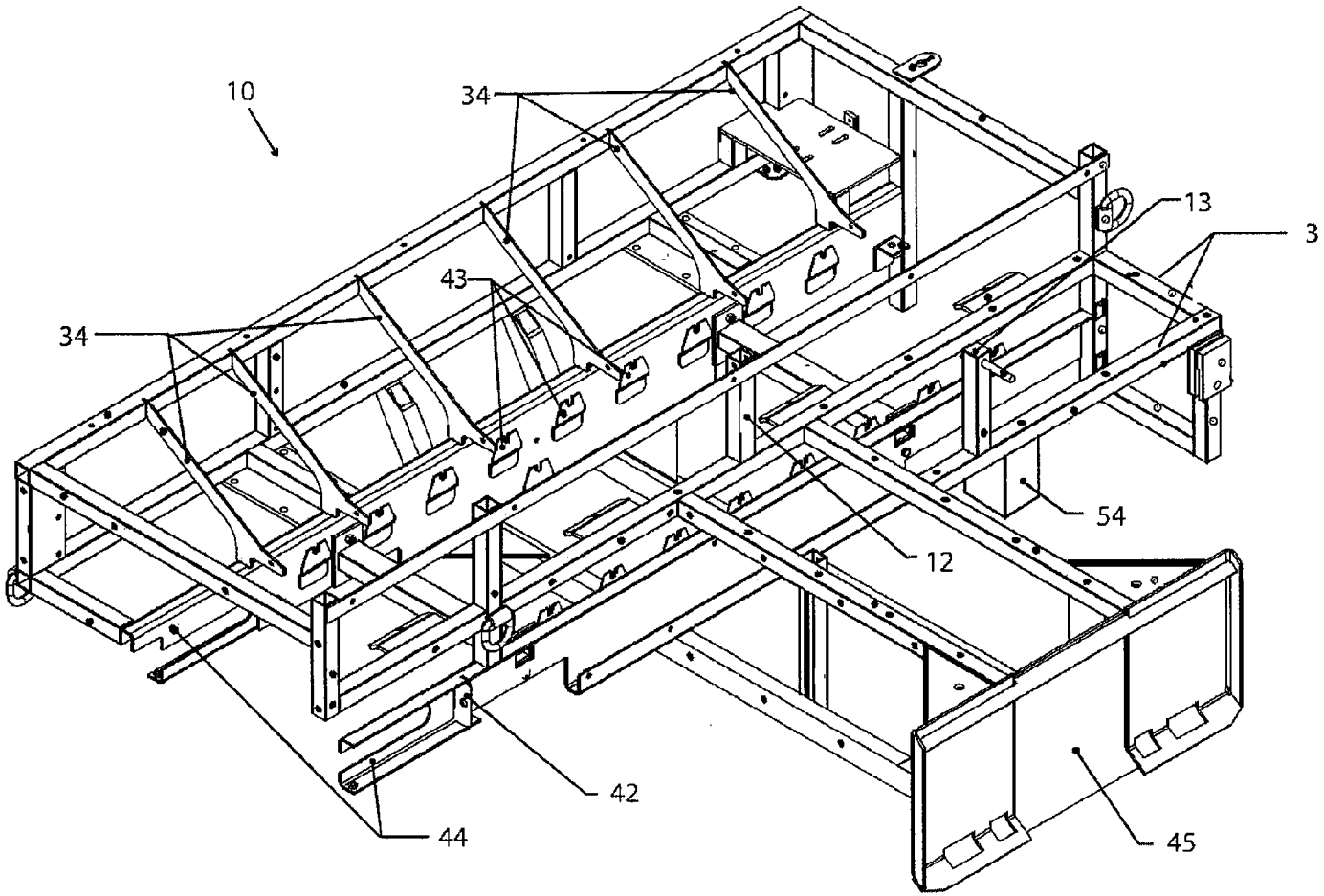
FIG. 9 illustrates an orthogonal view of the skeletal frame for an aggregate-spreading machine with a single spreader assembly.

FIG. 9 shows an orthographic view of the skeletal frame according to one embodiment of the invention. While the skeletal frame disclosed in FIG. 9 is very similar to the skeletal frame of the aggregate-spreading device disclosed in FIGS. 1-7 above, it is equipped for a single spreader assembly 14, shown in FIGS. 10-14. The concept is identical to the skeletal frame of the dual spreader assembly design disclosed in FIGS. 1-7. The only difference in the skeletal frame 10 design for the dual spreader assembly aggregate-spreading device is that the spreader attachment 3 as seen in FIG. 9 would be on both sides of the skeletal frame 10, along with another angular adjustment guide 47 and electronic actuator 54. As the skeletal frame 10 shown in FIG. 9 has a single-spreader attachment 3, the conveyor drive assembly mount 44 may be seen on the opposite side. The conveyor drive assembly mount 44 allows for simple attachment of the conveyor drive unit assembly 35 to the skeletal frame 10. Mount bars 39 are inserted into the mount insertion point 42 for positive retention and location of the conveyor drive unit assembly 35 to the skeletal frame 10. A plurality of front plate supports 34 functions as trusses to support the load on the skeletal frame 10 when the device is in use. The skeletal frame 10 also allows for easy repair and maintenance work to the aggregate-spreading device 1 as all the components may be removed from the skeletal frame 10. The skeletal frame 10 also makes the aggregate-spreading device 1 much lighter in weight as compared to previous devices that did not incorporate a skeletal frame 10.

Figure 10:
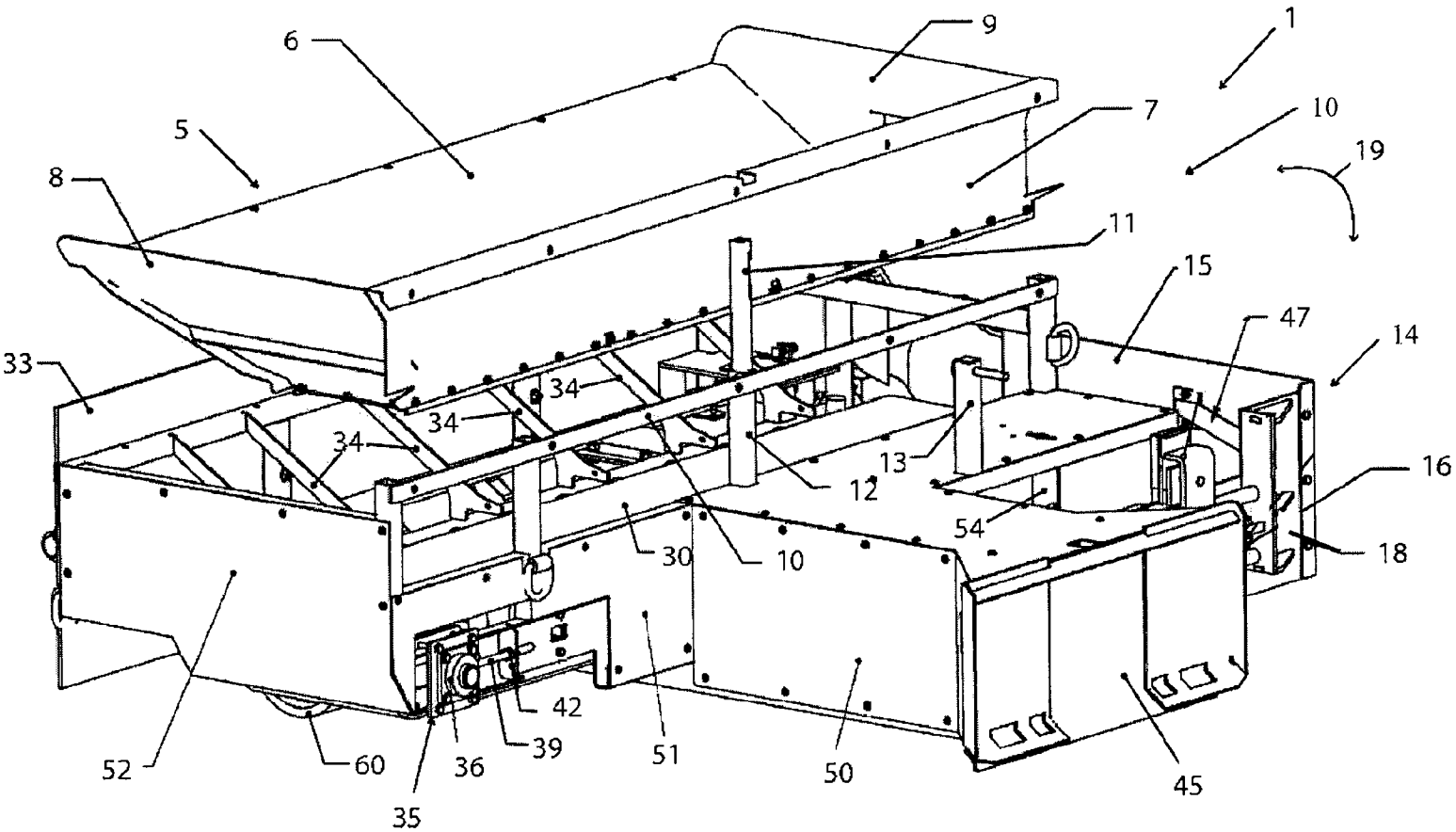
FIG. 10 illustrates an orthogonal view of the aggregate-spreading device equipped with a single spreader assembly.

FIG. 10 shows an orthographic view of an aggregate-spreading device 1 that includes a single spreader assembly 14. As there is only one spreader assembly 14, the side of the aggregate-spreading device 1 is exposed and other features may be seen. For example, the conveyor drive unit assembly 35 can be seen along with a threaded rod 39 that is attached to a threaded rod insertion point 42. While only a single conveyor drive unit assembly 35 is seen, all aggregate-spreading devices 1 optimally are equipped with a conveyor drive unit assembly 35 on each end of the conveyor 30. A side plate 52 strengthens the skeletal frame 10 and prevents aggregate from falling off the conveyor 30 on the side of the aggregate-spreading device 1 that does not include a spreader assembly 14. A back plate 51 and extension 50 also strengthen the skeletal frame 10. In all embodiments of the aggregate-spreading device 1, the various plates strengthening the skeletal frame may be removed and reattached in order to assist maintenance, repair, and cleaning of the aggregate-spreading device 1. The spreader assembly 14 may be extended to and from the skeletal frame 10 with the use of piston 16. The piston 16 may also angularly adjust 19 the spreader assembly 14 exactly as is shown and discussed in FIG. 2 and above. An angular-adjustment guide 47 is equipped to prevent over adjusting when making angular adjustments.

Figure 11:
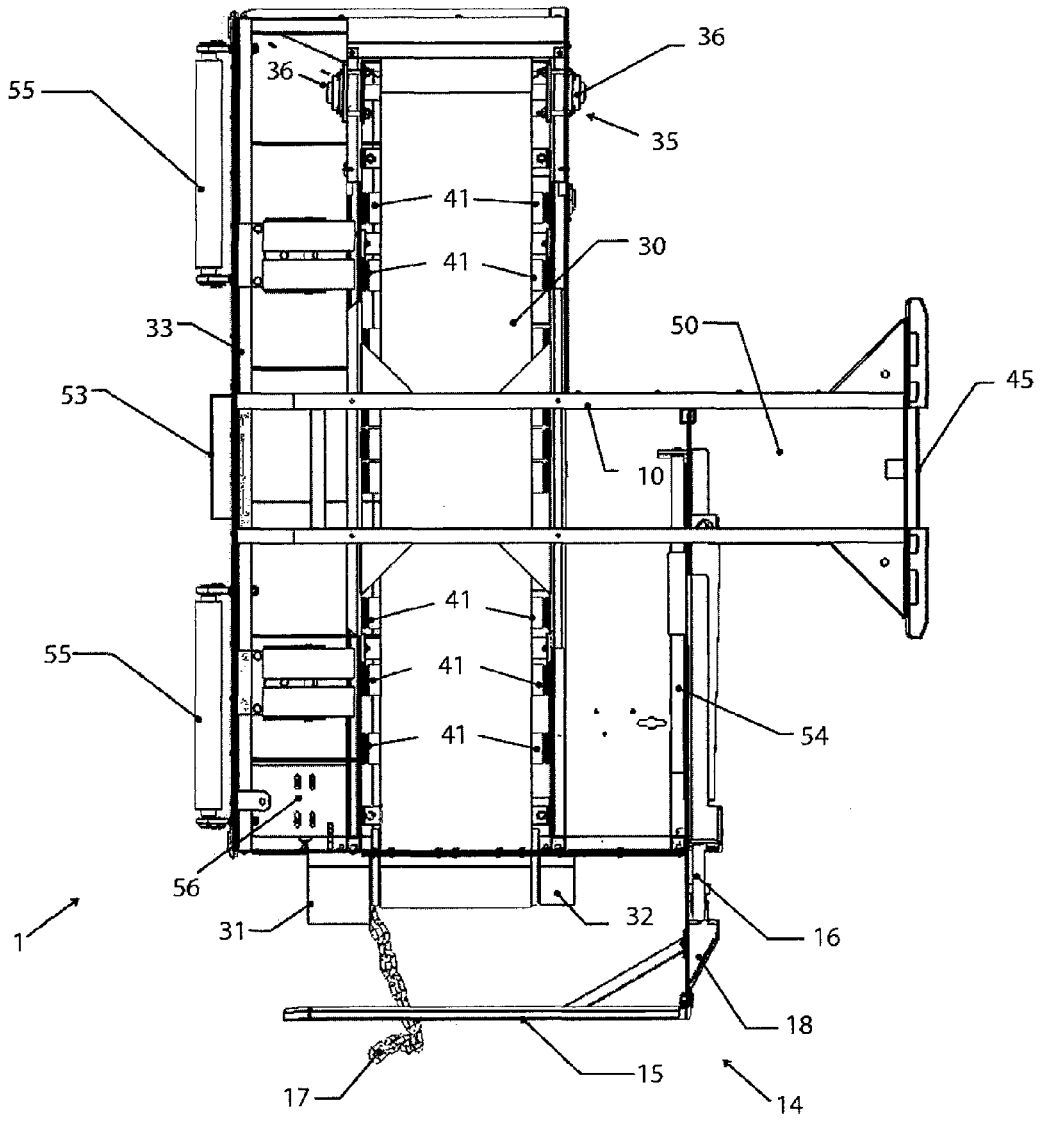
FIG. 11 illustrates a bottom view of the aggregate-spreading device of FIG. 10.

Turning to FIG. 11, a bottom view of the aggregate-spreading device 1 with a single spreader assembly 14 is shown. Just as in the dual spreader assembly embodiment, a plurality of rollers 41 assists the conveyor 30 in rotating. A conveyor motor 56 provides power to rotate the conveyor 30 preferably with the use of the chain attaching to the conveyor drive unit assembly 35. An electronic actuator 54 powers the movements of the spreader assembly 14 just as disclosed in the dual spreader assembly embodiment above. Electronic actuator 54 is controlled by a controller 57 that is preferably wireless and is also in communication with the conveyor motor 56 to control all functions of the conveyor motor and movement of the spreader assembly 14 with manual input from the operator. As the controller 57 may be located anywhere, an operator may manually control the functions of the aggregate-spreading device 1 from a vehicle pushing the device from the rear or, alternatively, for a vehicle supplying aggregate to the aggregate-spreading device 1 in the front. The aggregate spring device 1 may be attached to the vehicle in front of the device via auxiliary mounting plate 53, suspending the aggregate-spreading device 1 from the rear of the vehicle. Alternatively, the aggregate-spreading device 1 may be attached to a vehicle pushing the device from the rear by attaching a vehicle to the universal mount 45. This optional configuration allows the aggregate-spreading device 1 as disclosed in FIGS. 1-7 or in FIGS. 10-14 to be attached to the rear end of a dump truck 59 with the use of auxiliary mounting plate 53 as seen in FIG. 16, or to the front of the vehicle such as a skid steer 61 with the universal mount 45 as is seen in FIG. 15. In either configuration, the controller 57 may be located in the cabin of the dump truck 59 or in the skid steer 61 allowing the operator of either vehicle to operate the functions of the aggregate-spreading device 1.

When operating the aggregate-spreading device 1 from a remote location with the controller 57 from the interior of the dump truck 59 or from the interior of skid steer 61, a means for viewing is preferably used that enables the operator to see the aggregate coming out of the dump truck 59 and being supplied to any spreader assembly. The means for viewing may include a simple device such as a plurality of mirrors or a more sophisticated device such as video cameras mounted on the aggregate-spreading device 1 and monitors located inside the cabin of the respective vehicle. Such a configuration allows for a single person to operate the dump truck 59 and operate the aggregate-spreading device 1 when the aggregate-spreading device 1 is attached to the dump truck 59 as shown in FIG. 16.

Figure 12:
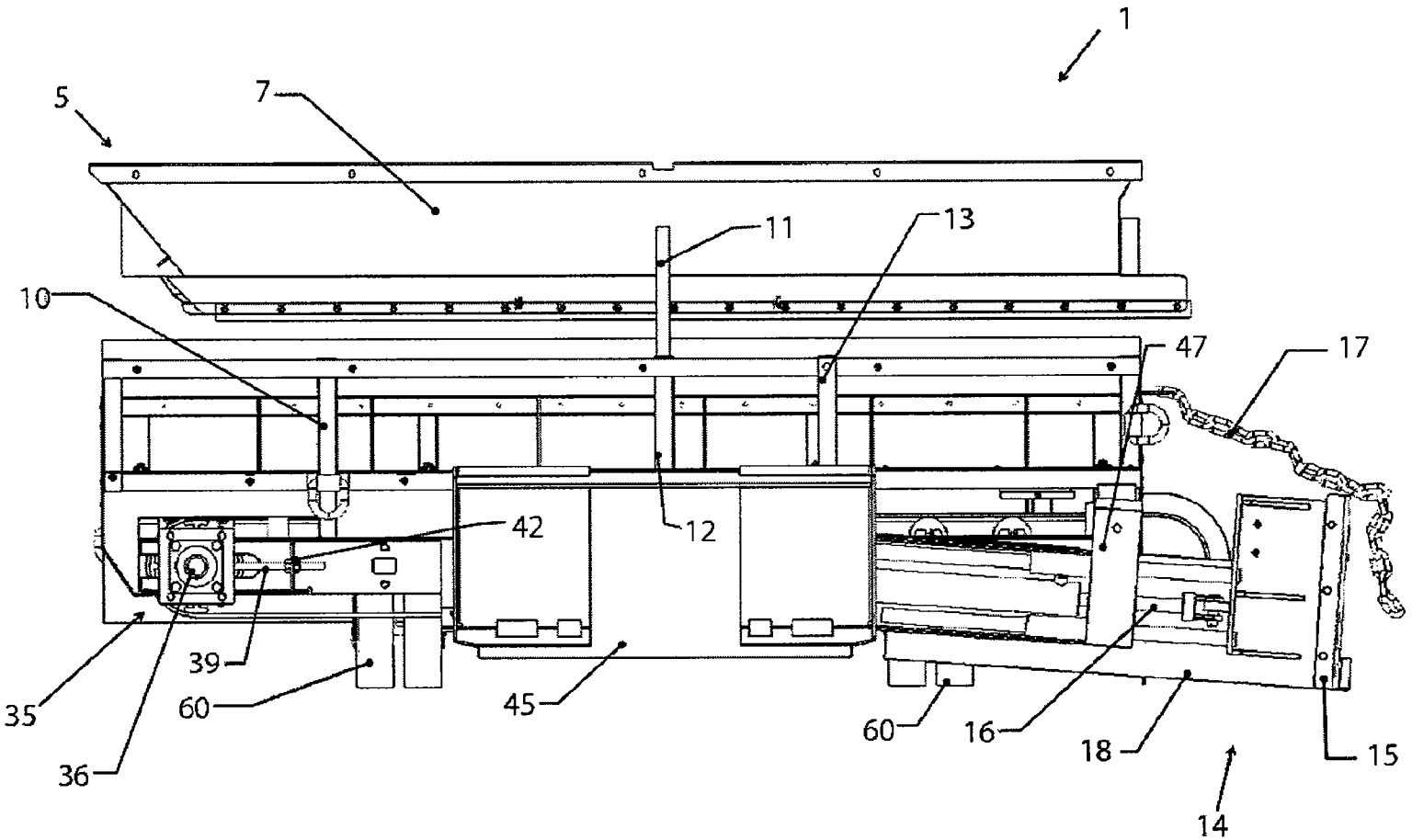
FIG. 12 illustrates a back view of the aggregate-spreading device of FIG. 10.
Figure 13:
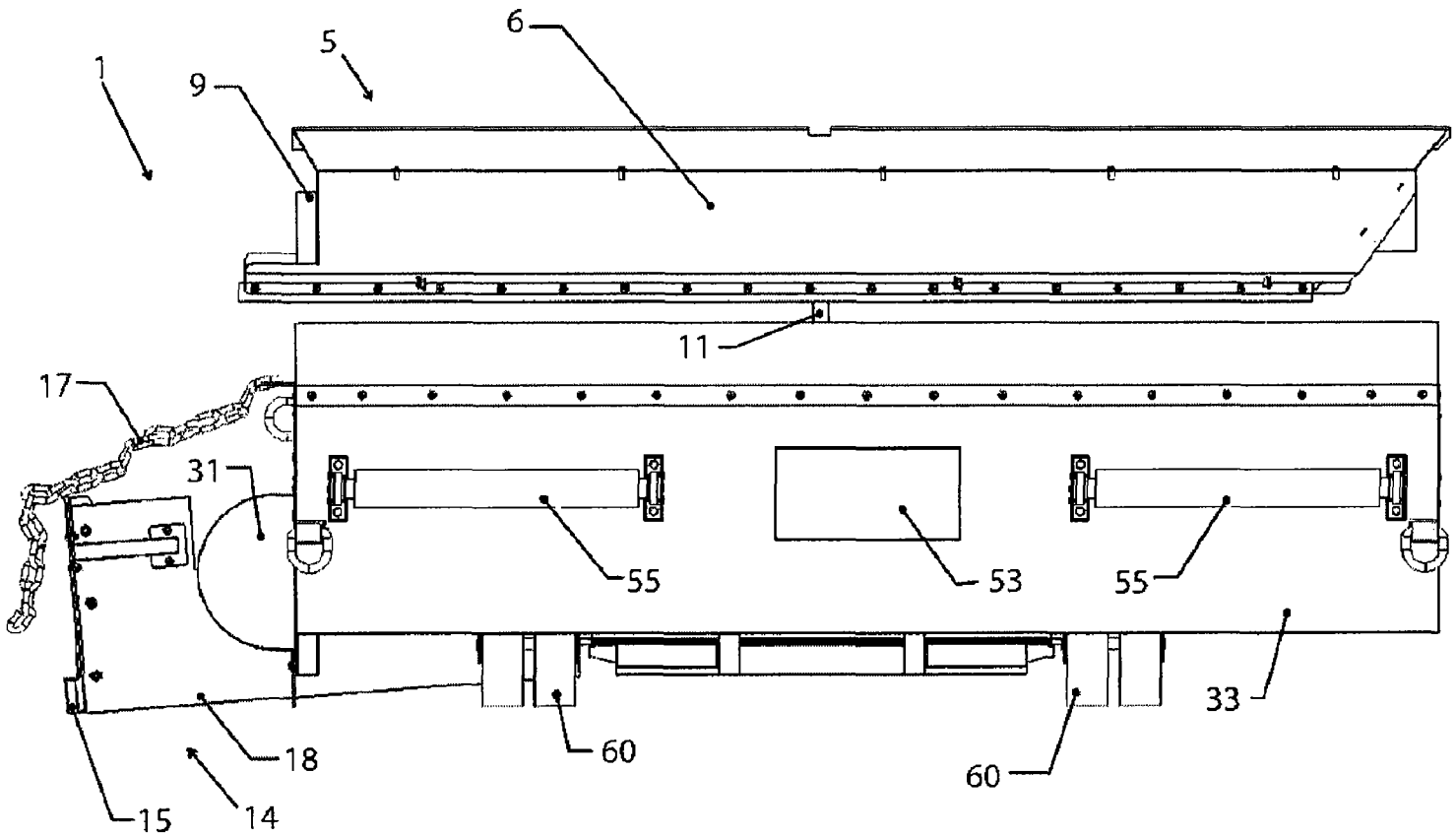
FIG. 13 illustrates a front view of the aggregate-spreading device of FIG. 10.
Figure 14:
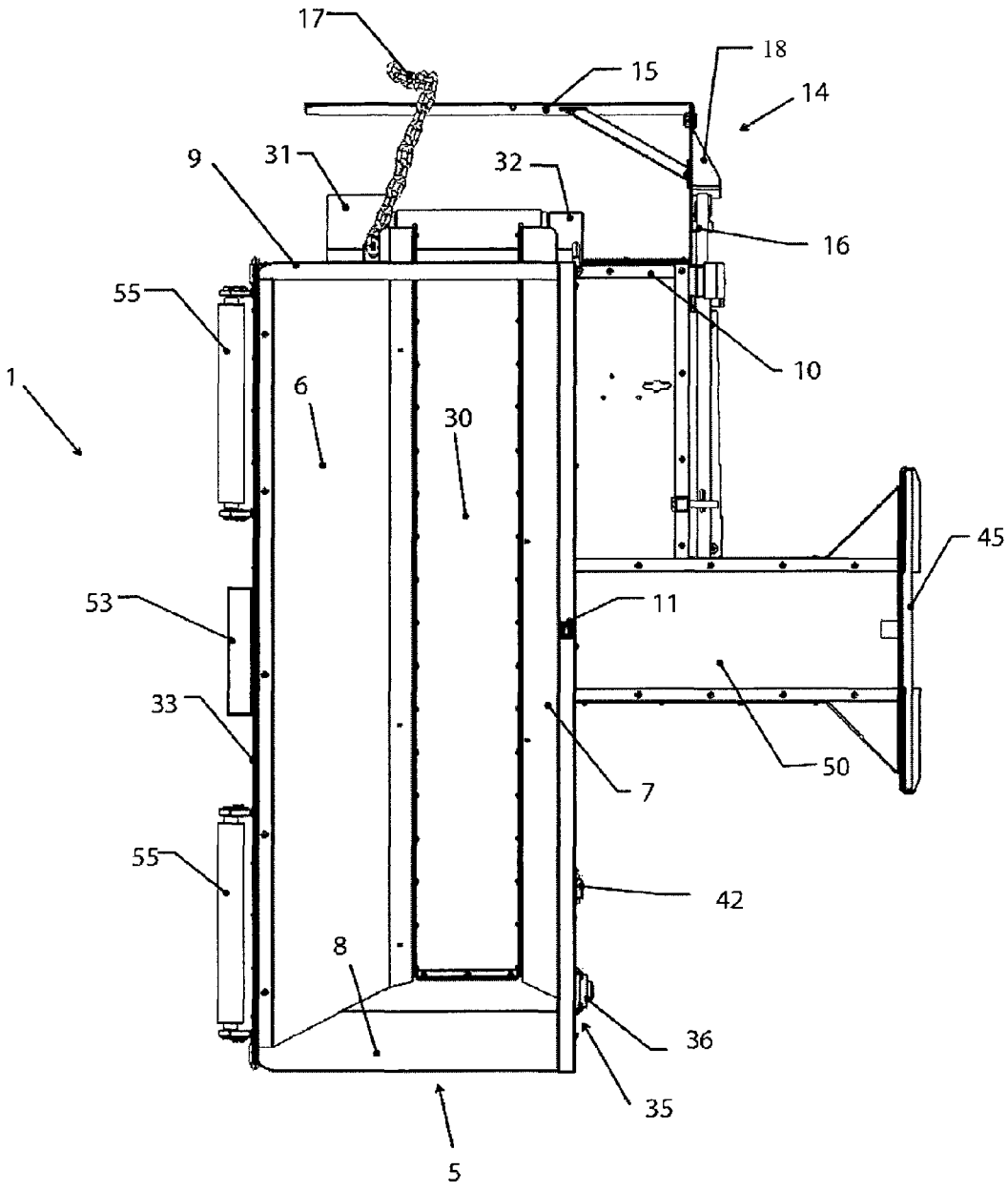
FIG. 14 illustrates a top view of the aggregate-spreading device of FIG. 10.

FIG. 12 shows a rear side view of the aggregate-spreading device 1 that includes a single spreader assembly 14. As there is only a single spreader assembly 14, the conveyor drive unit assembly 35, bearing 36, threaded rod 39, and threaded rod insertion point 42 are exposed on the opposite side of the skeletal frame 10. The hopper 5 is attached to the skeletal frame 10 by the hopper support bar 12. FIG. 13 discloses a front side view of the aggregate-spreading device 2 with a single spreader assembly 14, just as with the dual spreader configuration of FIGS. 1-7. The single spreader device includes a pair of contact rollers 55 attached to the front plate 33. The contact rollers 55 are designed to contact the rear wheels of a dump truck 59, as shown in FIG. 15, when the device is pushed from the rear with attachment of a skid steer 61 via the auxiliary universal mount 45. The wheels 60 allow the aggregate-spreading device 1 to roll on the ground as it is pushed by the skid steer 61 or when the device is suspended from the rear end of a dump truck as seen in FIG. 16 via the auxiliary mounting plate 53. The hopper 5 receives aggregate from a dump truck 59, as seen in FIGS. 15 and 16, and is suspended above the conveyor 30, as seen in FIG. 14, by a single attachment point, the hopper support bar 12. The spreader assembly 14 operates as discussed above.

A top side view of the aggregate-spreading device 1 with a single spreader assembly 14 is seen in FIG. 14. Looking inside the hopper 5, the side wall 8, front wall 6, cutout wall 9, and rear wall 7 are shown. Aggregate supplied to the hopper 5 is directed to fall directly on the conveyor 30 for delivery to the single spreader assembly 14 as the conveyor is rotated by the conveyor drive unit assembly 35. The bearing 36 assists the conveyor drive unit assembly 35 in rotation and the threaded rod insertion point 42 secures the threaded rod 39, seen in FIG. 8, to the skeletal frame 10 thus allowing the conveyor drive unit assembly 35 to be positionable for adjusting the tension of the conveyor 30. The universal mount 45, secured to the skeletal frame 10 and reinforced by the extension 50, allows attachment of the aggregate-spreading device 1 to a vehicle such as a skid steer 61, as seen in FIG. 15. The aggregate-spreading device 1 may alternatively be secured to the rear side of a dump truck 59 with the auxiliary mounting plate 53, as shown in FIG. 16.

Although the best mode contemplated by the inventor of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. An aggregate-spreading device comprising:

a skeletal frame;

a hopper attached to the skeletal frame by a single hopper support bar for receiving an aggregate from a first vehicle;

a conveyor system attached to the skeletal frame comprising a conveyor drive unit, a plurality of rollers, a conveyer engaging the conveyor drive unit and the plurality of rollers, and a reversible motor engaging the conveyor drive unit for rotating the conveyor and plurality of rollers in a first direction and to rotate the conveyor in a second direction;

a first spreader assembly attached to a first end of the skeletal frame with a variable extension distance from the skeletal frame;

a second spreader assembly attached to a second end of the skeletal frame opposite the first end with a variable extension distance from the skeletal frame; and a powering system for supplying electrical power to said aggregate-spreading device, the powering system including a manual controller in communication with the conveyor system, the first spreader assembly, and the second spreader assembly.

2. The aggregate-spreading device of claim 1 further including a mounting plate attached at a back end of the skeletal frame for engagement with a second vehicle, the second vehicle configured to push the aggregate-spreading device behind the first vehicle.

3. The aggregate-spreading device of claim 1 further including a remote location for the manual controller configured to locate the manual controller in the first vehicle, the manual controller configured to control the reversible motor for supplying the aggregate to the first spreader system when rotating the conveyor in the first direction and to supply the aggregate to the second spreader system when rotating the conveyor in the second direction.

4. The aggregate-spreading device of claim 3 further including a plurality of electronic actuators in communication with the manual controller, the plurality of actuators configured to operate the first and second spreader systems, a conveyor rotation speed, the reversible motor, and the variable extension distance of the first and second spreader assemblies.

5. The aggregate-spreading device of claim 4 further including an auxiliary mounting plate attached to a front end of the skeletal frame configured to suspend the skeletal frame behind a rear end of the first vehicle.

6. The aggregate-spreading device of claim 2 further including a remote location for the manual controller configured to locate the manual controller in the second vehicle, the manual controller configured to:

a) control the reversible motor for supplying the aggregate to the first spreader system when rotating the conveyor in the first direction;

b) supply the aggregate to the second spreader system when rotating the conveyor in the second direction; and c) control the variable extension distance from the skeletal frame of the first and second spreader assemblies.

7. The aggregate-spreading device of claim 5 wherein the conveyor drive unit comprises:

a) a plurality of T-shaped extensions converging on a single roller with two ends;

b) a bearing attached to each one of the two ends; and c) a pair of threaded rods engaging the skeletal frame, wherein the conveyer engages the T shaped extensions.

8. The aggregate-spreading device of claim 7 further including a plurality of plates attached to the skeletal frame that enclose the skeletal frame and provide structural support to the skeletal frame, the plurality of plates configured to be removable and re-attachable for any one of a repair operation, an assembly operation, and a maintenance operation of the aggregate-spreading device.

9. An aggregate-spreading device comprising:

a skeletal frame with a plurality of integrated roller mounts;

a hopper connected to the skeletal frame, the hopper configured to receive an aggregate from a proximate vehicle;

a single hopper support bar configured to support the hopper above the skeletal frame at an adjustable distance;

a conveyor system attached to the skeletal frame including:

a) a conveyor drive unit with a plurality of threaded rods engaging the skeletal frame, the conveyor drive unit including a plurality of T shaped extensions with ends in contact with the conveyor, the T shaped extensions converging on a single roller with ends;

b) a bearing joined to each one of the ends of the single roller;

c) a conveyer with an adjustable speed and a reversible rotation configured to receive the aggregate from the hopper, a plurality of rollers attached to the integrated roller mounts; and d) a spreader assembly attached to an end of the skeletal including:

i. a controllable piston configured to extend and retract the spreader assembly from the skeletal frame wherein the spreader assembly receives the aggregate from the conveyor and spreads the aggregate evenly.

10. The aggregate-spreading device of claim 9 further including a mounting plate attached to a back end of the skeletal frame for engagement with a second vehicle, the second vehicle configured to push the aggregate-spreading behind the proximate vehicle.

11. The aggregate-spreading device of claim 10 further including:

a plurality of electronic actuators and a plurality of electronic motors in communicative control of the conveyor drive unit and the spreader assembly, wherein the plurality of electronic actuators and the plurality of electronic motors adjust the conveyor adjustable speed, and control the piston.

12. The aggregate-spreading device of claim 11 further including:

a controller in communication with the conveyor system and the spreader assembly, the controller programmed to accept a manual input from an operator for controlling the plurality of electronic actuators and the plurality of electronic motors.

13. The aggregate-spreading device of claim 12 further including:

a remote location for the controller, the remote location including the interior of the second vehicle; and a plurality of plates attached to the skeletal frame, enclosing the skeletal frame and providing structural support to the skeletal frame, the plurality of plates configured to be removable and re-attachable for any one of a repair operation, an assembly operation, and a maintenance operation of the aggregate-spreading device.

14. An aggregate-spreading device comprising:

a skeletal frame with a plurality of integrated roller mounts and an adjustable sleeve;

a hopper with a single hopper support bar configured to support the hopper above the skeletal frame at a distance;

a proximate vehicle configured to deliver an aggregate to the hopper;

a conveyor system fastened to the skeletal frame including:

a) a conveyor drive unit with a pair of threaded rods engaging the skeletal frame;

b) a plurality of T shaped extensions converging on a single roller with two ends;

c) a bearing on each one of the two ends;

d) a plurality of rollers attached to the integrated roller mounts;

e) a conveyer engaging the T shaped extensions and the plurality of rollers;

f) a spreader assembly attached to a first end of the skeletal frame including:

i. a controllable piston configured to extend and retract the spreader assembly from the skeletal frame, wherein the spreader assembly receives the aggregate from the conveyor system and spreads the aggregate evenly; and ii. an auxiliary mounting plate integrated to a front end of the skeletal frame configured to engage the skeletal frame behind a rear end of the proximate vehicle.

15. The aggregate-spreading device of claim 14 further including a conveyer motor with an adjustable speed and a reversible rotation, the conveyor motor configured to drive the conveyor drive unit and rotate the conveyor in a first direction, a second direction, and at a controllable speed.

16. The aggregate-spreading device of claim 15 further including:

a plurality of electronic actuators and a plurality of electronic motors configured to control the piston for extending and retracting the spreader assembly from the skeletal frame; and a controller in wireless communication with the conveyor system and the spreader assembly, the controller programmed to accept a manual input from an operator for controlling the conveyor motor, the plurality of electronic actuators, and the plurality of electronic motors.

17. The aggregate-spreading device of claim 16 further including a remote location for the controller, the remote location including a cabin of the proximate vehicle for allowing the operator to control the conveyor motor, the plurality of electronic actuators, and the plurality of electronic motors from an interior of the cabin.

18. The aggregate-spreading device of claim 17 further including:

a plurality of plates removably connected to the skeletal frame and configured to enclose the skeletal frame for providing structural support, wherein the plurality of plates are configured to be removed for any one of a repair operation, an assembly operation, and a maintenance operation of the aggregate-spreading device.

19. The aggregate-spreading device of claim 16 further including:

a mounting plate attached at a back end of the skeletal frame for engagement with a second vehicle, the second vehicle configured to push the aggregate-spreading device behind the proximate vehicle; and a remote location for the controller, the remote location including a cabin of the second vehicle configured to allow the operator to control the conveyor motor, the plurality of electronic actuators, and the plurality of electronic motors from within the cabin.

20. The aggregate-spreading device of claim 14 further including a second spreader assembly attached to a second end of the skeletal frame opposite the first end with a variable extension distance from the skeletal frame, the second spreader assembly including a controllable piston configured to extend and retract the second spreader assembly from the skeletal frame, wherein the second spreader assembly receives the aggregate from the conveyor and spreads the aggregate evenly.

* * * * *